US012059078B1

(12) United States Patent
Jin et al.

(10) Patent No.: US 12,059,078 B1
(45) Date of Patent: Aug. 13, 2024

(54) PACKAGING-OPTIMIZED DETACHABLE SOFA

(71) Applicant: HONG KONG WUDI INTERNATIONAL TRADING CO., LIMITED, Hong Kong (CN)

(72) Inventors: Jiachen Jin, Shanghai (CN); Jie Zhu, Shanghai (CN)

(73) Assignee: HONG KONG WUDI INTERNATIONAL TRADING CO., LIMITED, Hong Kong (CN)

( * ) Notice: Subject to any disclaimer, the term of this patent is extended or adjusted under 35 U.S.C. 154(b) by 0 days.

(21) Appl. No.: 18/588,003

(22) Filed: Feb. 27, 2024

(30) Foreign Application Priority Data

Jan. 8, 2024 (CN) ..... 202420043528.6

(51) Int. Cl.

| | |
|---|---|
| ***A47C 4/02*** | (2006.01) |
| ***A47C 1/034*** | (2006.01) |
| ***A47C 4/30*** | (2006.01) |
| ***A47C 7/42*** | (2006.01) |
| ***A47C 7/52*** | (2006.01) |
| ***A47C 7/54*** | (2006.01) |
| ***A47C 7/62*** | (2006.01) |

(52) U.S. Cl.
CPC ..... *A47C 4/02* (2013.01); *A47C 1/0342* (2013.01); *A47C 4/028* (2013.01); *A47C 4/30* (2013.01); *A47C 7/42* (2013.01); *A47C 7/52* (2013.01); *A47C 7/546* (2013.01); *A47C 7/624* (2018.08)

(58) Field of Classification Search
CPC ..... A47C 4/02; A47C 1/0342; A47C 4/028; A47C 4/30; A47C 7/42; A47C 7/52; A47C 7/546; A47C 7/624
USPC ..... 297/184.14, 184.19, 184.2, 227, 228.1, 297/411.27, 411.44, 411.46, 440.11, 297/440.14, 440.15; 206/326
See application file for complete search history.

(56) References Cited

U.S. PATENT DOCUMENTS

| | | | | |
|---|---|---|---|---|
| 8,408,653 | B2 * | 4/2013 | Griggs, Jr. | A47C 4/08 297/440.16 |
| 2006/0103220 | A1 * | 5/2006 | Wade | A47C 4/02 297/440.14 |
| 2017/0347799 | A1 * | 12/2017 | Sewell | A47C 4/028 |

(Continued)

FOREIGN PATENT DOCUMENTS

| | | | |
|---|---|---|---|
| CN | 216059924 | U | 3/2022 |

*Primary Examiner* — Robert Canfield
(74) *Attorney, Agent, or Firm* — Bayramoglu Law Offices LLC

(57) ABSTRACT

A packaging-optimized detachable sofa includes a backrest support, two armrest frames, a seat cushion frame, a footrest, and a folding mechanism, where the folding mechanism includes two link assemblies; the two link assemblies are respectively detachably provided at inner sides of the two armrest frames; the seat cushion frame is detachably provided at middle inner sides of the two link assemblies; the two link assemblies each include one end detachably connected to a bottom end of the backrest support and the other end detachably connected to the footrest; the armrest frames are respectively covered by armrest skins; when the packaging-optimized detachable sofa is in a storage state, each component is disassembled from the folding mechanism; and the folding mechanism each are placed in accommodating spaces covered by the armrest skins at sides of the armrest frames.

10 Claims, 16 Drawing Sheets

(56) References Cited

U.S. PATENT DOCUMENTS

| | | | | |
|---|---|---|---|---|
| 2019/0116978 | A1* | 4/2019 | Jorbel | A47C 1/0342 |
| 2021/0093087 | A1* | 4/2021 | Zei | A47C 4/028 |
| 2022/0104622 | A1* | 4/2022 | Chen | A47C 7/546 |
| 2023/0270252 | A1* | 8/2023 | Shih | A47C 17/02<br>297/440.11 |

* cited by examiner

PACKAGING-OPTIMIZED DETACHABLE SOFA

CROSS REFERENCE TO THE RELATED APPLICATIONS

This application is based upon and claims priority to Chinese Patent Application No. 202420043528.6, filed on Jan. 8, 2024, the entire contents of which are incorporated herein by reference.

TECHNICAL FIELD

The present disclosure relates to the technical field of sofas, and in particular to a packaging-optimized detachable sofa.

BACKGROUND

Sofas are a common and essential type of seat for home life. At present, sofas on the market usually include an integrated backrest and seat body that are not detachable and have a large volume and weight, making them inconvenient to transport and load and resulting in high transportation costs.

Chinese patent application CN216059924U provides a leisure sofa with detachable sofa legs, and relates to the technical field of furniture. The leisure sofa includes a sofa body, support legs, and a connecting mechanism. The sofa body includes a seat plate and a backrest. The support legs are arranged below four corners at a bottom end of the seat plate and connected to the seat plate through the connecting mechanism. The connecting mechanism includes mounting boxes, fixing grooves, and fixing elements. The mounting boxes are provided at the four corners at the bottom end of the seat plate. The bottom ends of the mounting boxes are provided with the fixing grooves. The top ends of the support legs are provided with the fixing elements that are matched with the fixing grooves. One end of the mounting box is provided with a locking mechanism for fixing the fixing element. The fixing elements and the fixing grooves are matched to quickly disassemble the support legs, avoiding damage on the support legs caused by collision during transportation. However, the detachable design of the leisure sofa is limited to the connection between the sofa body and the support legs, but the sofa itself is not detachable, resulting in the need for a large space for transportation and the failure of volume minimization.

SUMMARY

In view of the defects in the prior art, an objective of the present disclosure is to provide a packaging-optimized detachable sofa.

The packaging-optimized detachable sofa includes a backrest support, two armrest frames, two armrest connecting rods, a seat cushion frame, a footrest, and a folding mechanism, where the folding mechanism includes two link assemblies; the two link assemblies are respectively detachably provided at inner sides of the two armrest frames; and the two armrest frames are connected at front and rear ends thereof through the two armrest connecting rods;

the seat cushion frame is detachably provided at middle inner sides of the two link assemblies; the two link assemblies each include one end detachably connected to a bottom end of the backrest support and the other end detachably connected to the footrest; the backrest support is covered by a backrest skin; the armrest frames are respectively covered by armrest skins; and the seat cushion frame and the footrest each are provided with a cushion; and the packaging-optimized detachable sofa is provided with a storage state; when the packaging-optimized detachable sofa is in the storage state, the backrest support, the armrest frames, the seat cushion frame, and the footrest are disassembled from the folding mechanism; and the folding mechanism and the armrest connecting rods are placed in accommodating spaces covered by the armrest skins at sides of the armrest frames.

Preferably, the backrest support is a U-shaped wooden board structure; and a front side of the backrest support is provided with multiple backrest webbings arranged in parallel; and the bottom end of the backrest support is fixedly connected to the one end of each of the link assemblies through a backrest fixing member; the backrest fixing member and the one end of each of the link assemblies are respectively located at inner and outer sides of the bottom end of the backrest support; and the backrest fixing member, the one end of each of the link assemblies, and the backrest support are detachably connected by screws.

Preferably, an opening is provided at a bottom of the backrest skin; and the backrest support enters the backrest skin through the opening at the bottom of the backrest skin.

Preferably, a middle of the link assembly is provided with a seat cushion mounting crossbar and an armrest mounting crossbar; and the seat cushion mounting crossbar is located above the armrest mounting crossbar.

Preferably, the armrest frames each include a wooden frame structure and a wooden board structure located at an inner side of the wooden frame structure; the wooden frame structure and the wooden board structure form the accommodating space at an outer side of the armrest frame; and the accommodating space is matched with the folding mechanism in terms of size; and the wooden frame structure and the armrest mounting crossbar are provided with corresponding threaded holes; the armrest frame is detachably connected to the armrest mounting crossbar through a second screw; and the second screw passes through the threaded hole of the wooden frame structure and is threaded to the threaded hole of the armrest mounting crossbar.

Preferably, the seat cushion frame includes a spring layer, a connecting piece, a first seat cushion frame, and a second seat cushion frame; and the spring layer includes multiple springs arranged in parallel; and the spring layer, the first seat cushion frame, and the second seat cushion frame are fixedly connected in sequence from top to bottom through first screws; and two ends of the connecting piece are respectively fixed at inner sides of the first seat cushion frame and the second seat cushion frame through the first screws.

Preferably, an outer side of the second seat cushion frame and the seat cushion mounting crossbar are provided with corresponding threaded holes; the second seat cushion frame is detachably connected to the seat cushion mounting crossbar through a second screw; and the second screw passes through the threaded hole of the seat cushion mounting crossbar and is threaded to the threaded hole of the second seat cushion frame; and the first seat cushion frame is detachably connected to one end of the cushion, and the other end of the cushion is detachably connected to the footrest.

Preferably, two ends of the armrest connecting rod are detachably connected to bottoms of the wooden frame structures or wooden board structures of the two armrest frames through third screws; and a bottom corner inside the wooden frame structure is provided with a triangular support element; the bottom of the wooden frame structure is detachably connected to a sofa leg; and a gasket is provided between the sofa leg and the wooden frame structure.

Preferably, the armrest connecting rods are matched with the accommodating spaces at the outer sides of the armrest frames in terms of size; and when the packaging-optimized detachable sofa is in the storage state, the two armrest connecting rods and the folding mechanism are placed in the accommodating spaces at the outer sides of the two armrest frames; and the armrest frames are inserted into the armrest skins through the openings at the outer sides of the armrest skins; and the openings at the outer sides of the armrest skins are sealed with felt.

Preferably, the other end of each of the link assemblies is detachably connected to the footrest through a second screw.

Compared with the prior art, the present disclosure has the following beneficial effects:

The present disclosure features a simple structure and convenient operation. The backrest, the armrests, and the seat cushion of the sofa are detachably connected to the folding mechanism, making the sofa body detachable. The armrests and the folding mechanism are stored together in the armrest skin, and the components are properly stored. The design achieves volume minimization, saves transportation space, and avoids damage of sofa components caused by collision during transportation.

BRIEF DESCRIPTION OF THE DRAWINGS

Other features, objectives, and advantages of the present disclosure will become more apparent by reading the detailed description of non-limiting embodiments with reference to the following drawings.

Figure 1:
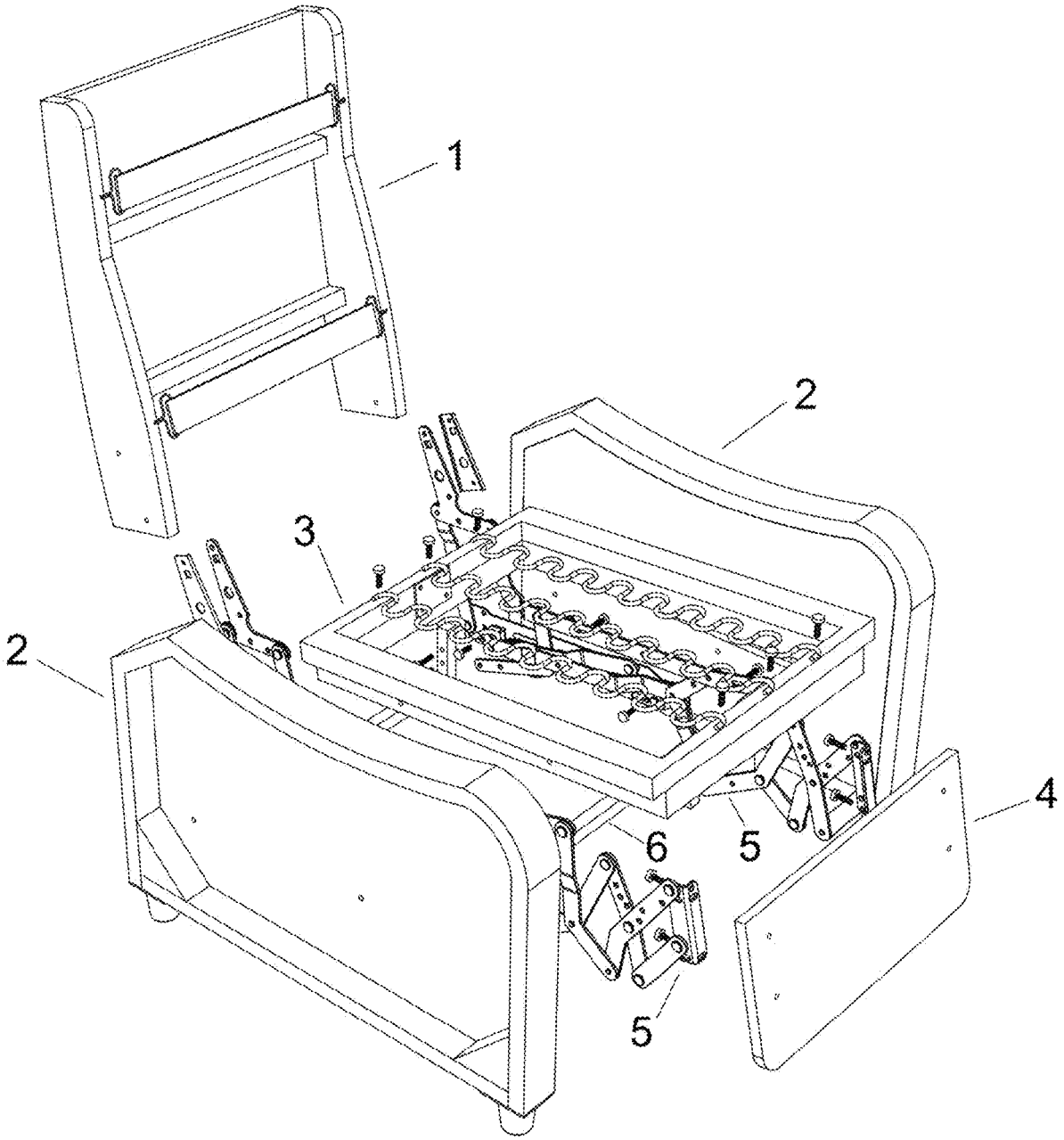
FIG. 1 is an exploded view of a packaging-optimized detachable sofa with a skin removed according to the present disclosure.

| Reference Numerals: |
|---|
| 1. backrest support; |
| 1-1. backrest webbing; |
| 2. armrest frame; |
| 2-1. armrest sidewall; |
| 2-2. support element; |
| 2-3. gasket; |
| 2-4. sofa leg; |
| 3. seat cushion frame; |
| 3-1. spring; |
| 3-2. first screw; |
| 3-3. connecting piece; |
| 3-4. first seat cushion frame; |
| 3-5. second seat cushion frame; |
| 4. footrest; |
| 5. folding mechanism; |
| 5-1. backrest fixing member; |
| 5-2. second screw; |
| 6. armrest connecting rod; and |
| 6-1. third screw. |

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

The present disclosure provides a packaging-optimized detachable sofa. The sofa includes a backrest, armrests, and a seat cushion, which are detachably connected to a folding mechanism, making the sofa body detachable and the components properly stored. The design achieves volume minimization, saves transportation space, and avoids damage of sofa components caused by collision during transportation.

Figure 3:
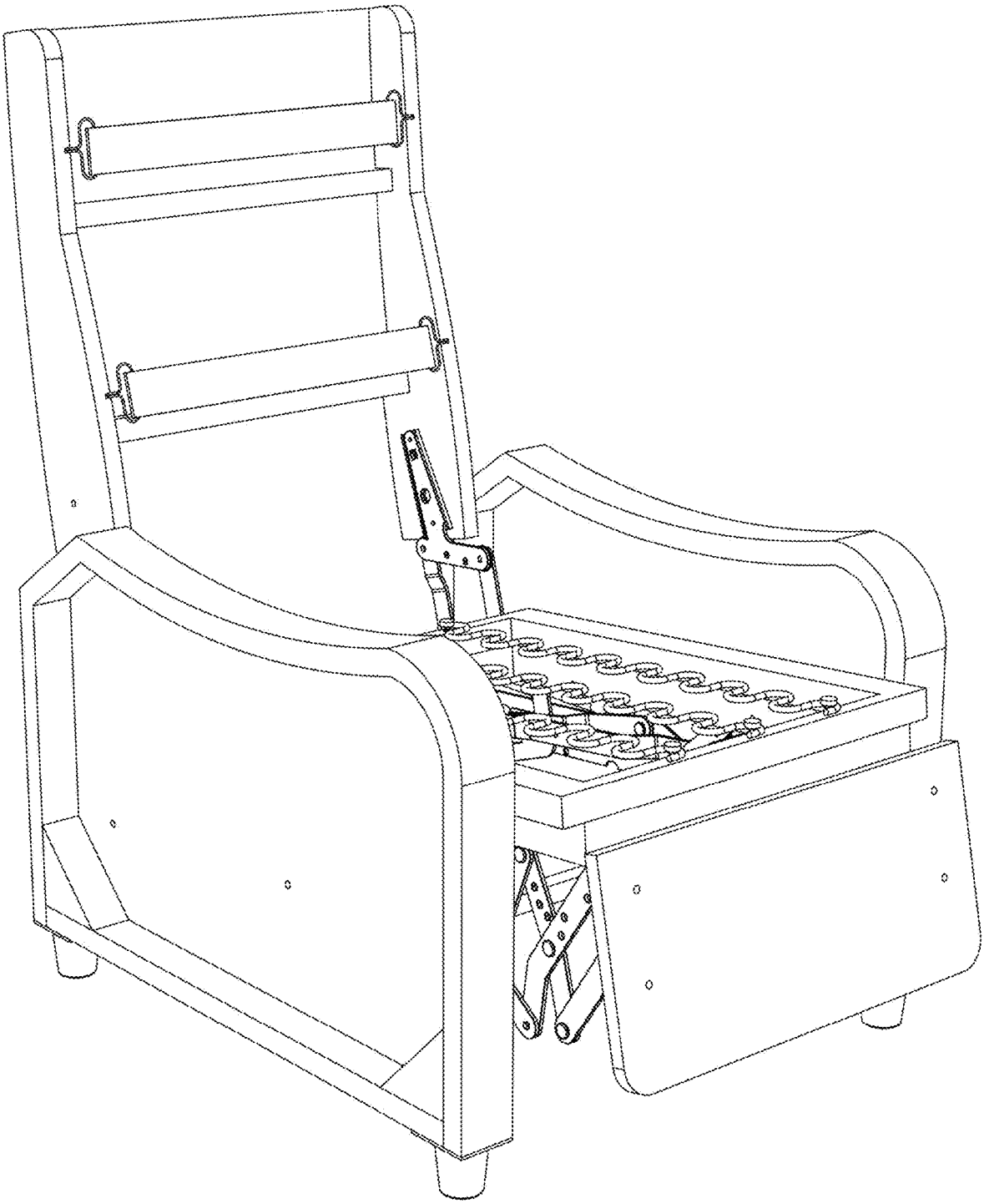
FIG. 3 is an overall structural diagram of the packaging-optimized detachable sofa with the skin removed according to the present disclosure.

In the present disclosure, as shown in FIGS. 1 and 3, the packaging-optimized detachable sofa includes backrest support 1, two armrest frames 2, seat cushion frame 3, footrest 4, and folding mechanism 5. The folding mechanism 5 includes two link assemblies. The two link assemblies are respectively detachably provided at inner sides of the two armrest frames 2.

Figure 2:
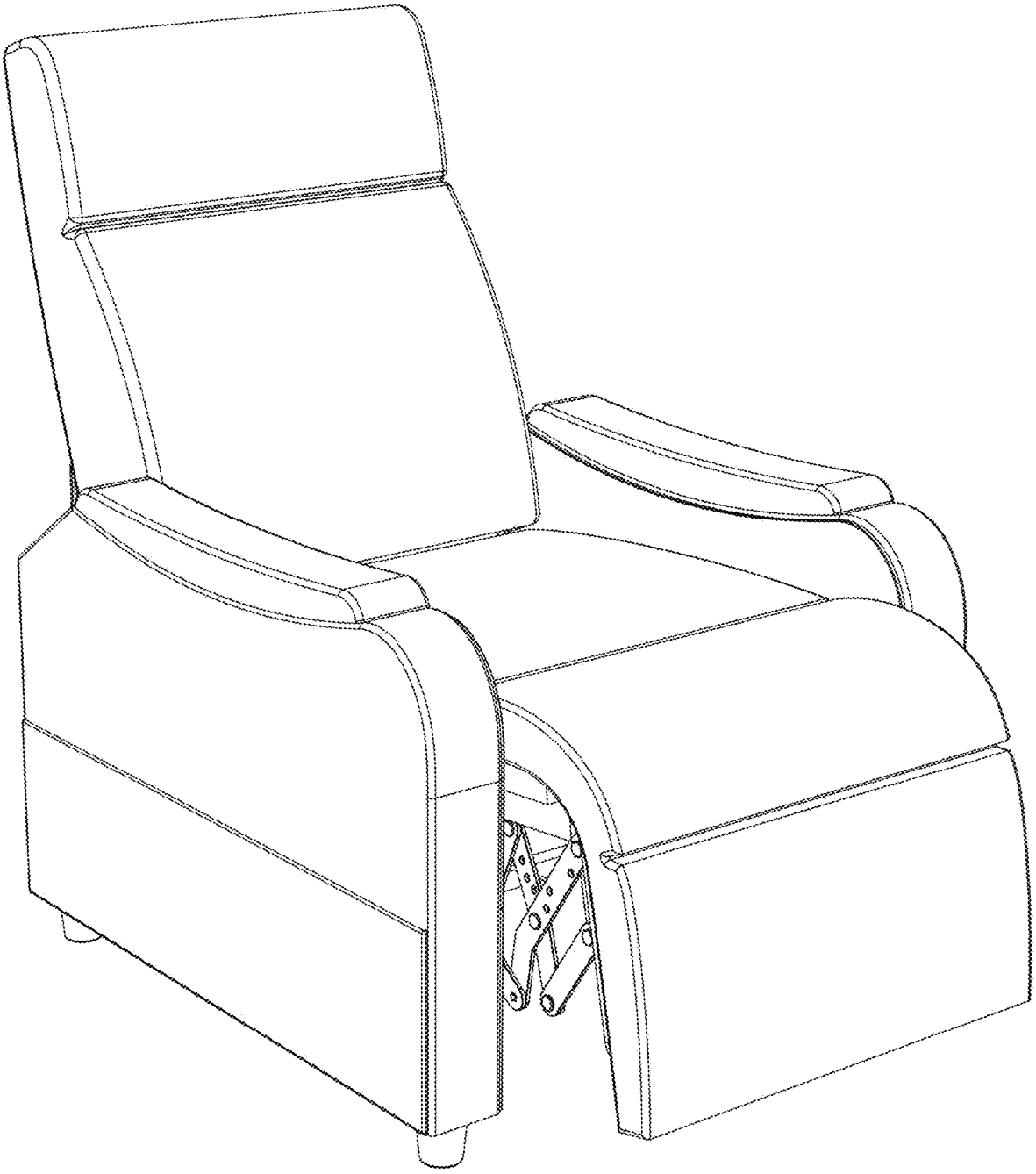
FIG. 2 is an overall structural diagram of the packaging-optimized detachable sofa according to the present disclosure.

The seat cushion frame 3 is detachably provided at middle inner sides of the two link assemblies. The two link assemblies each include one end detachably connected to a bottom end of the backrest support 1 and the other end detachably connected to the footrest 4. As shown in FIG. 2, the backrest support 1 is covered by a backrest skin. The armrest frames 2 are respectively covered by armrest skins. The seat cushion frame 3 and the footrest 4 each are provided with a cushion.

The packaging-optimized detachable sofa is provided with a storage state. When the packaging-optimized detachable sofa is in the storage state, the backrest support 1, the armrest frames 2, the seat cushion frame 3, and the footrest 4 are disassembled from the folding mechanism 5. The folding mechanism 5 each are placed in accommodating spaces covered by the armrest skins at sides of the armrest frames 2. The solution achieves reasonable storage and a detachable structure, greatly saving transportation space and reducing the risk of damage caused by collision during transportation.

Embodiment 1

Figure 14:
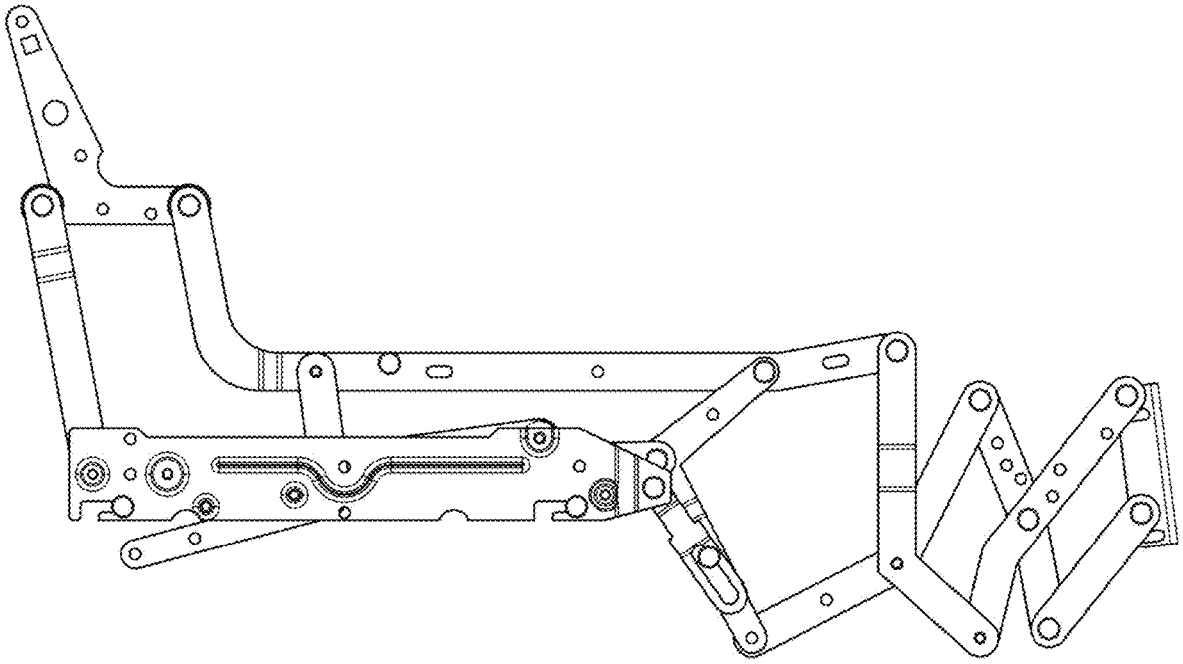
FIG. 14 is a lateral view of the folding mechanism from an angle according to the present disclosure.
Figure 15:
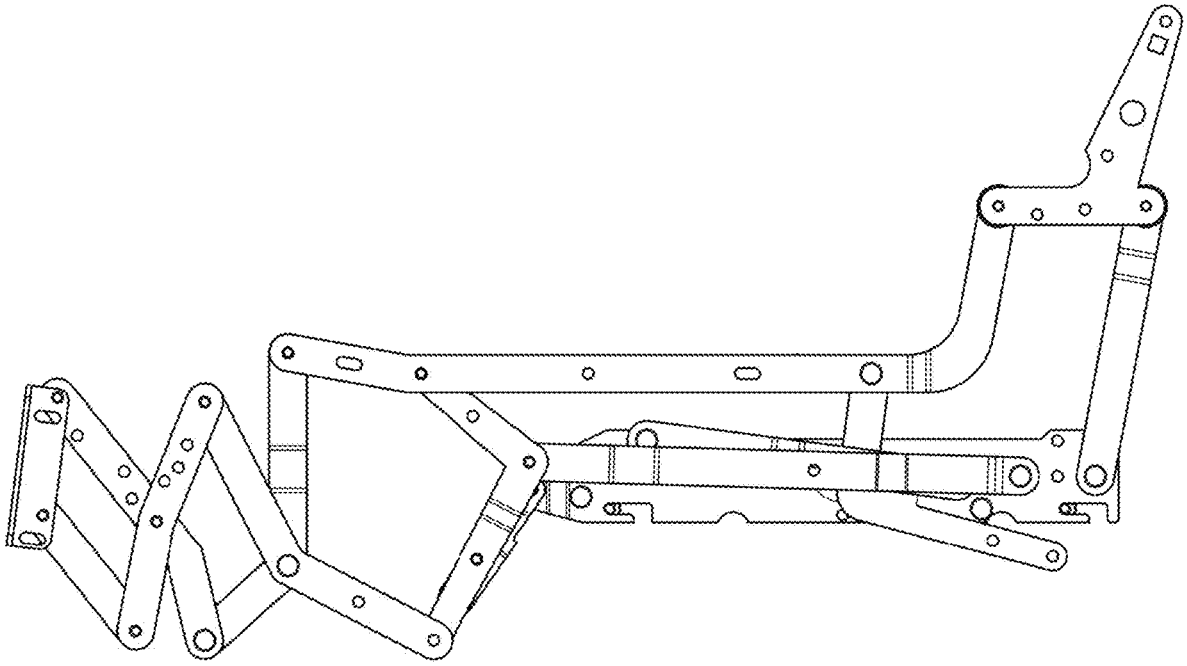
FIG. 15 is a lateral view of the folding mechanism from another angle according to the present disclosure.
Figure 16:
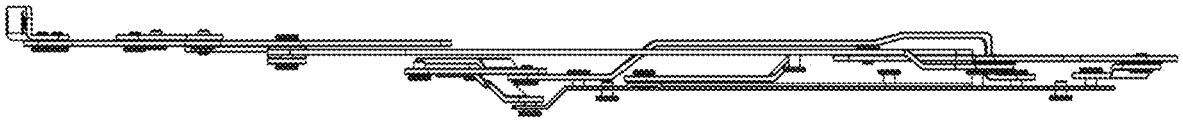
FIG. 16 is a top view of the folding mechanism according to the present disclosure.

This embodiment is a preferred embodiment of the above basic embodiment, and provides a packaging-optimized detachable sofa. FIGS. 14 to 16 are detailed drawings of the folding mechanism 5. The folding mechanism 5 connects the backrest support 1, the armrest frames 2, the seat cushion frame 3, and the footrest 4 to form an overall linkage. The seat cushion frame 3 and the footrest 4 can be raised and lowered to a comfortable position and angle through the folding mechanism 5, improving the sitting comfort and overall comfort of the sofa.

Figure 5:
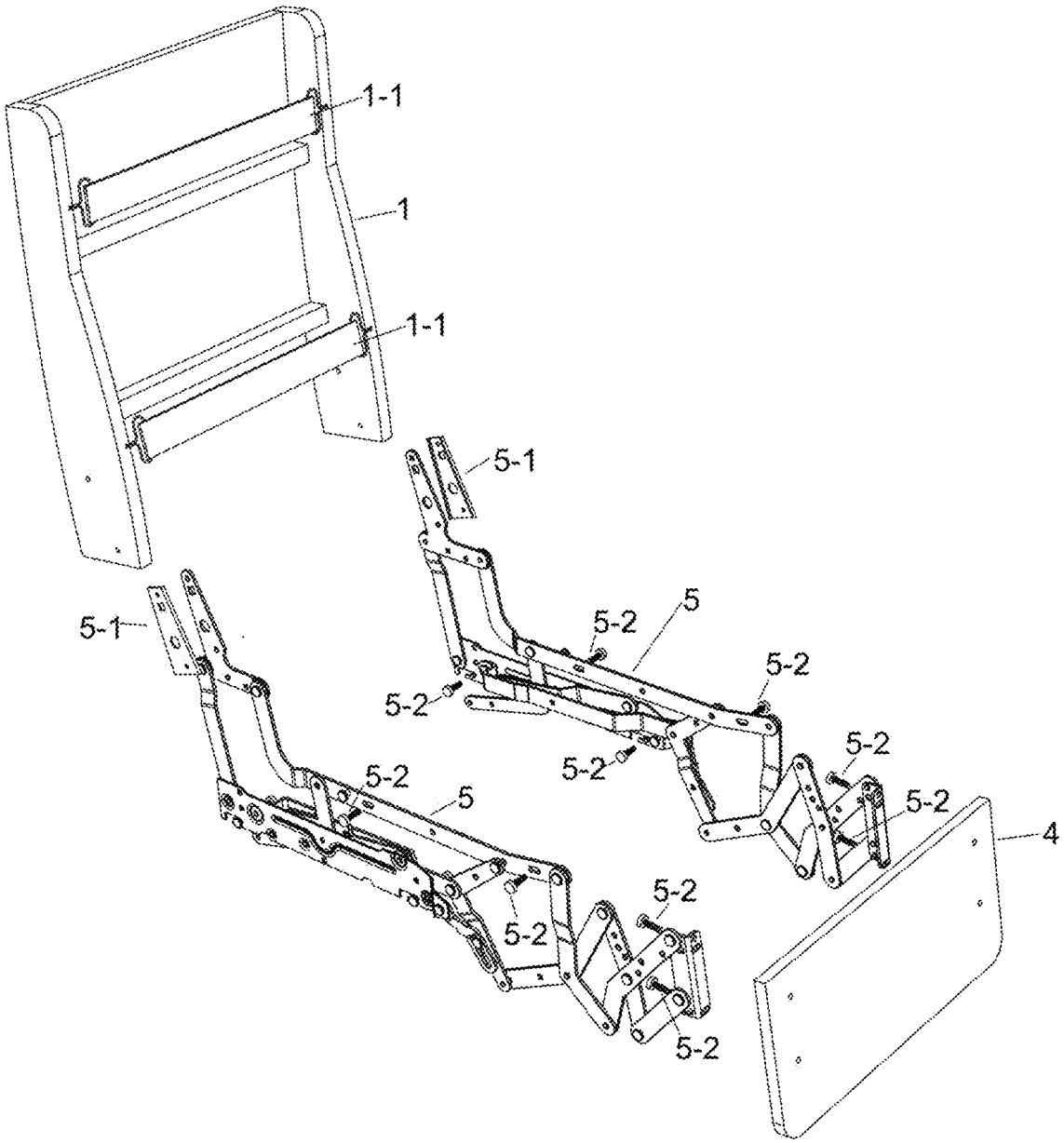
FIG. 5 is a connection diagram of a backrest support, a footrest, and a folding mechanism of the packaging-optimized detachable sofa according to the present disclosure.
Figure 12:
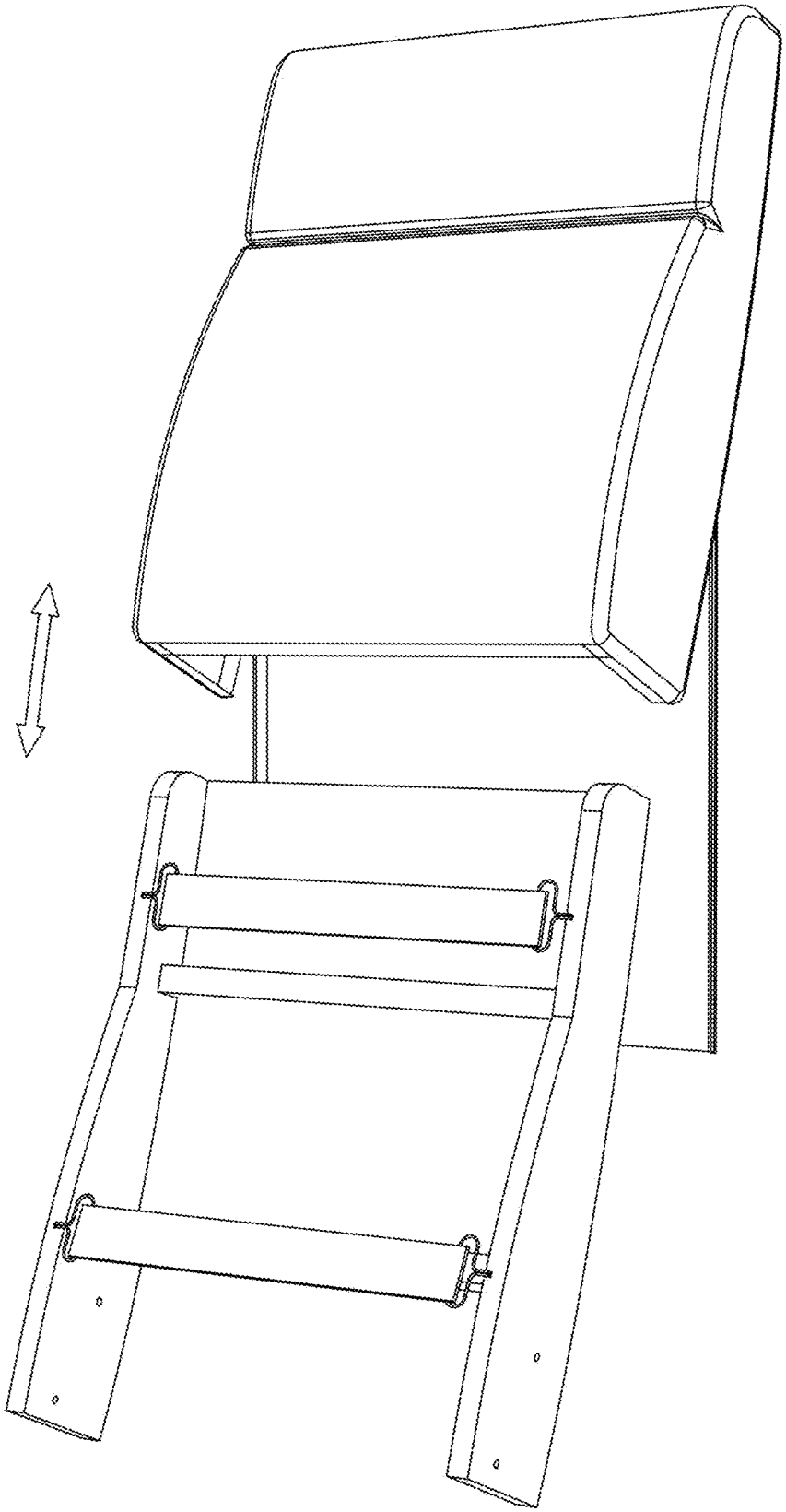
FIG. 12 is a structural diagram of the backrest support placed in a backrest skin according to the present disclosure.
Figure 13:
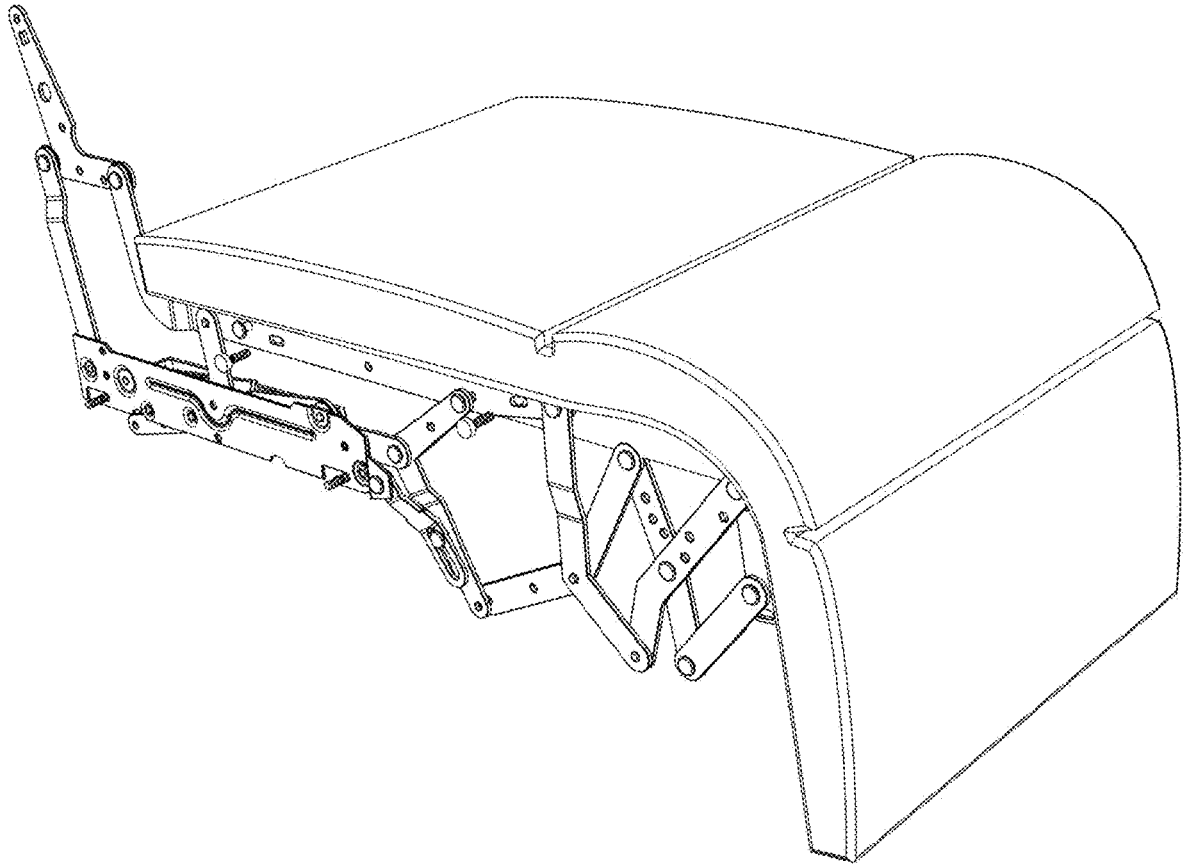
FIG. 13 is a connection diagram of the folding mechanism and the seat cushion frame as well as the footrest provided with a cushion according to the present disclosure.

As shown in FIG. 12, the backrest support 1 is a U-shaped wooden board structure. A front side of the backrest support 1 is provided with multiple backrest webbings 1-1 arranged in parallel to increase backrest elasticity. FIG. 5 shows a connection mode between the backrest support, the folding mechanism, and the footrest. The bottom end of the backrest support 1 is fixedly connected to the one end of each of the link assemblies through backrest fixing member 5-1. The backrest fixing member 5-1 and the one end of each of the link assemblies are respectively located at inner and outer sides of the bottom end of the backrest support 1. The backrest fixing member, the one end of each of the link assemblies, and the backrest support are detachably connected by screws. The other end of each of the link assemblies is detachably connected to the footrest 4 through second screw 5-2. As shown in FIG. 12, an opening is provided at a bottom of the backrest skin, and the backrest support 1 enters the backrest skin through the opening at the bottom of the backrest skin.

Figure 6:
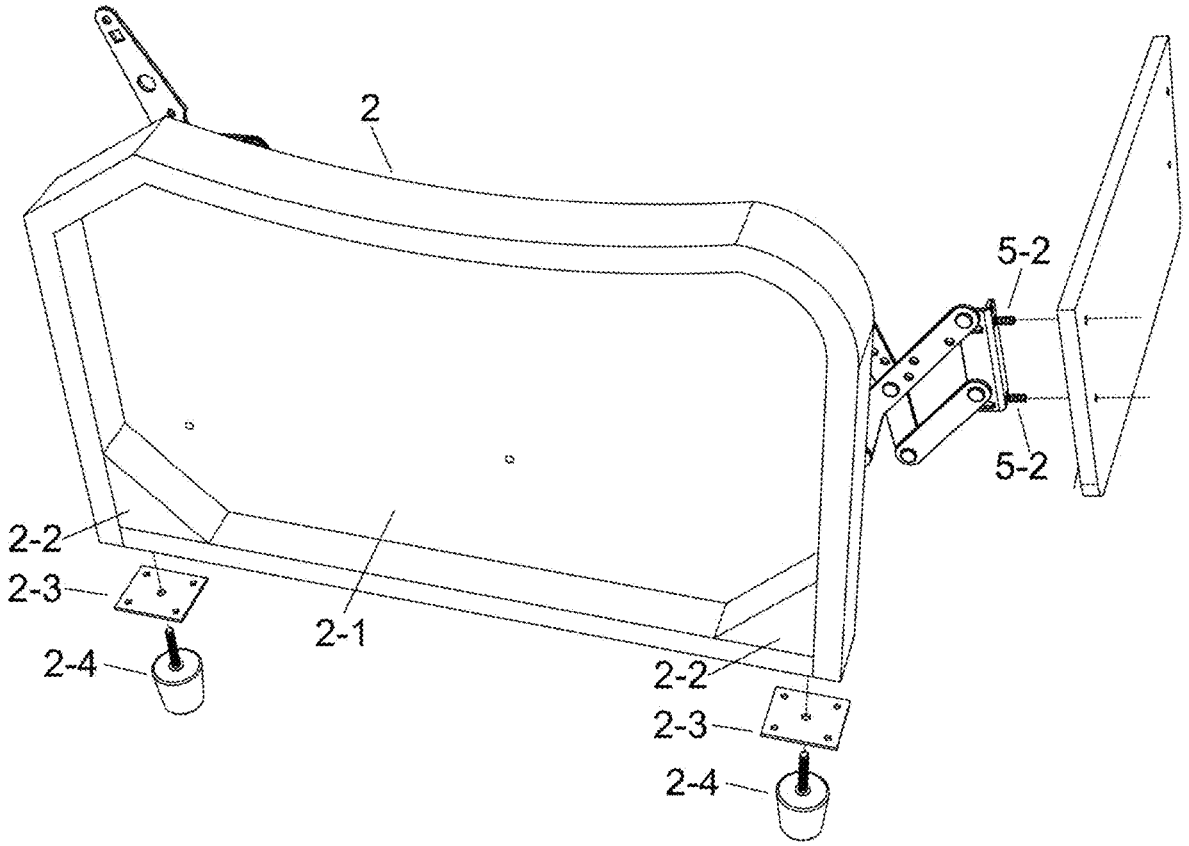
FIG. 6 is a connection diagram of the armrest frame, the footrest, and the folding mechanism of the packaging-optimized detachable sofa according to the present disclosure.

FIG. 6 shows a fixing mode between the folding mechanism and the seat cushion frame. A middle of the link assembly is provided with a seat cushion mounting crossbar and an armrest mounting crossbar. The seat cushion mounting crossbar is located above the armrest mounting crossbar. The armrest frames 2 each include a wooden frame structure and a wooden board structure located at an inner side of the wooden frame structure. The wooden frame structure and the wooden board structure form the accommodating space at an outer side of the armrest frame 2. The accommodating space is matched with the folding mechanism 5 in terms of size. The wooden frame structure and the armrest mounting crossbar are provided with corresponding threaded holes. The armrest frame 2 is detachably connected to the armrest mounting crossbar through second screw 5-2. The second screw 5-2 passes through the threaded hole of the wooden frame structure and is threaded to the threaded hole of the armrest mounting crossbar.

Figure 8:
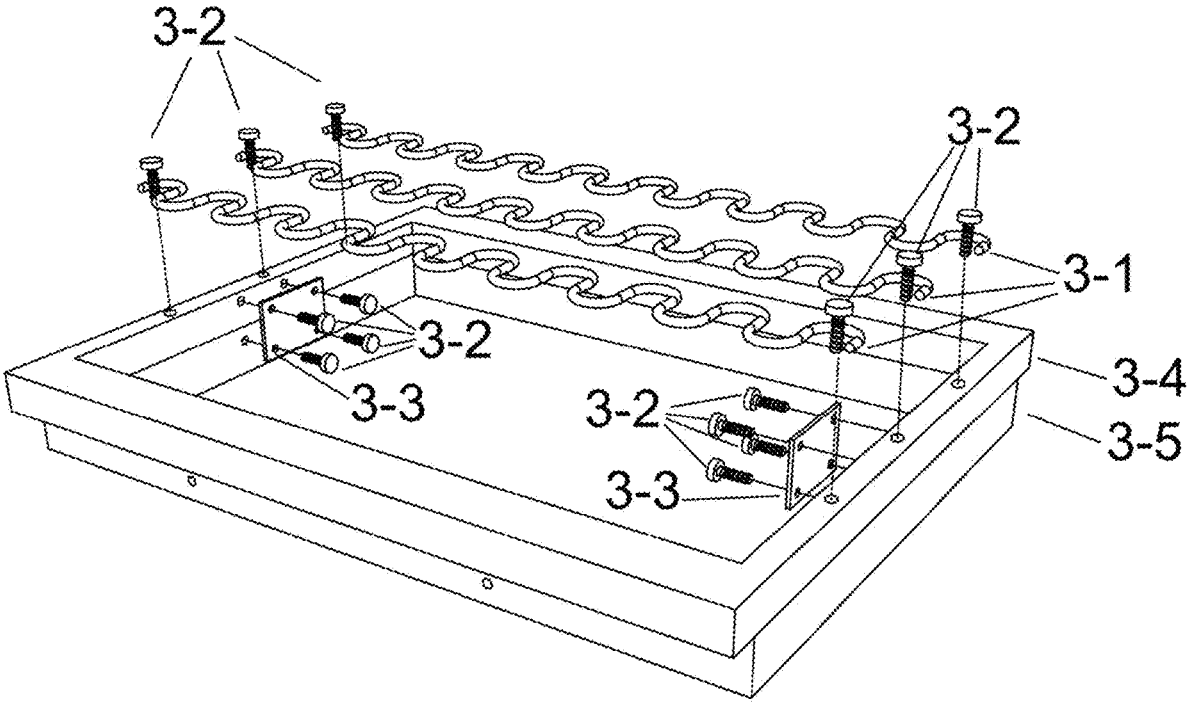
FIG. 8 is an exploded view of the seat cushion frame of the packaging-optimized detachable sofa according to the present disclosure.
Figure 9:
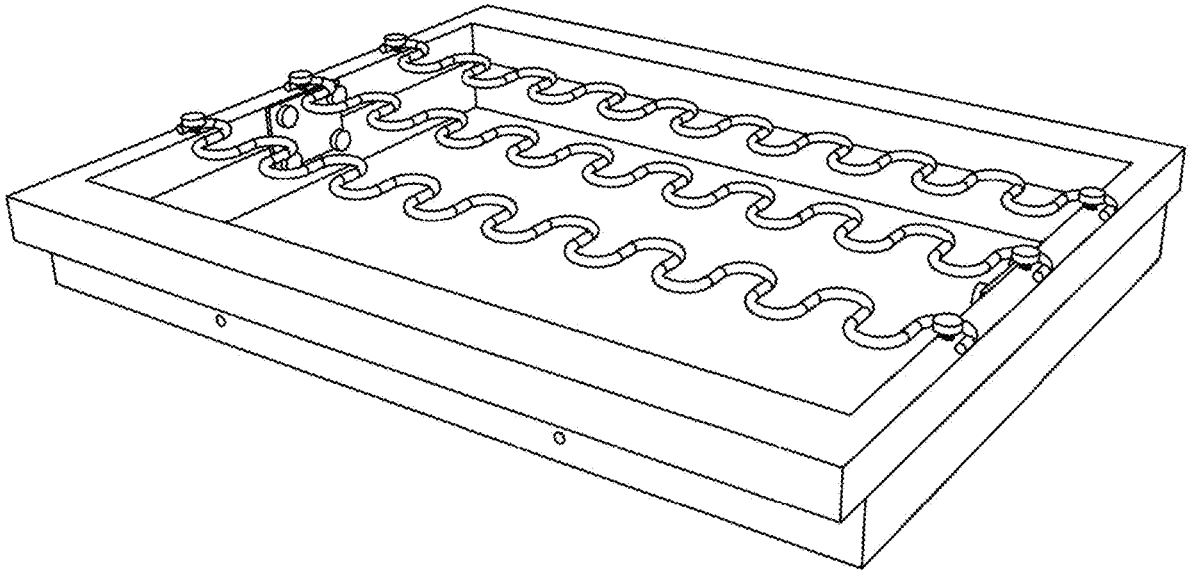
FIG. 9 is a structural diagram of the seat cushion frame of the packaging-optimized detachable sofa according to the present disclosure.

FIGS. 8 and 9 are structural diagrams of the seat cushion frame. The seat cushion frame 3 includes a spring layer, connecting piece 3-3, first seat cushion frame 3-4, and second seat cushion frame 3-5. The spring layer includes multiple springs 3-1 arranged in parallel. The spring layer, the first seat cushion frame 3-4, and the second seat cushion frame 3-5 are fixedly connected in sequence from top to bottom through first screws 3-2. Two ends of the connecting piece 3-3 are respectively fixed at inner sides of the first seat cushion frame 3-4 and the second seat cushion frame 3-5 through the first screws 3-2. The spring layer is provided at a top of the first seat cushion frame 3-4 to increase the elasticity and comfort of the seat cushion. The first seat cushion frame 3-4 and the second seat cushion frame 3-5 are fixed by the first screws 3-2 passing through the connecting piece 3-3.

Figure 7:
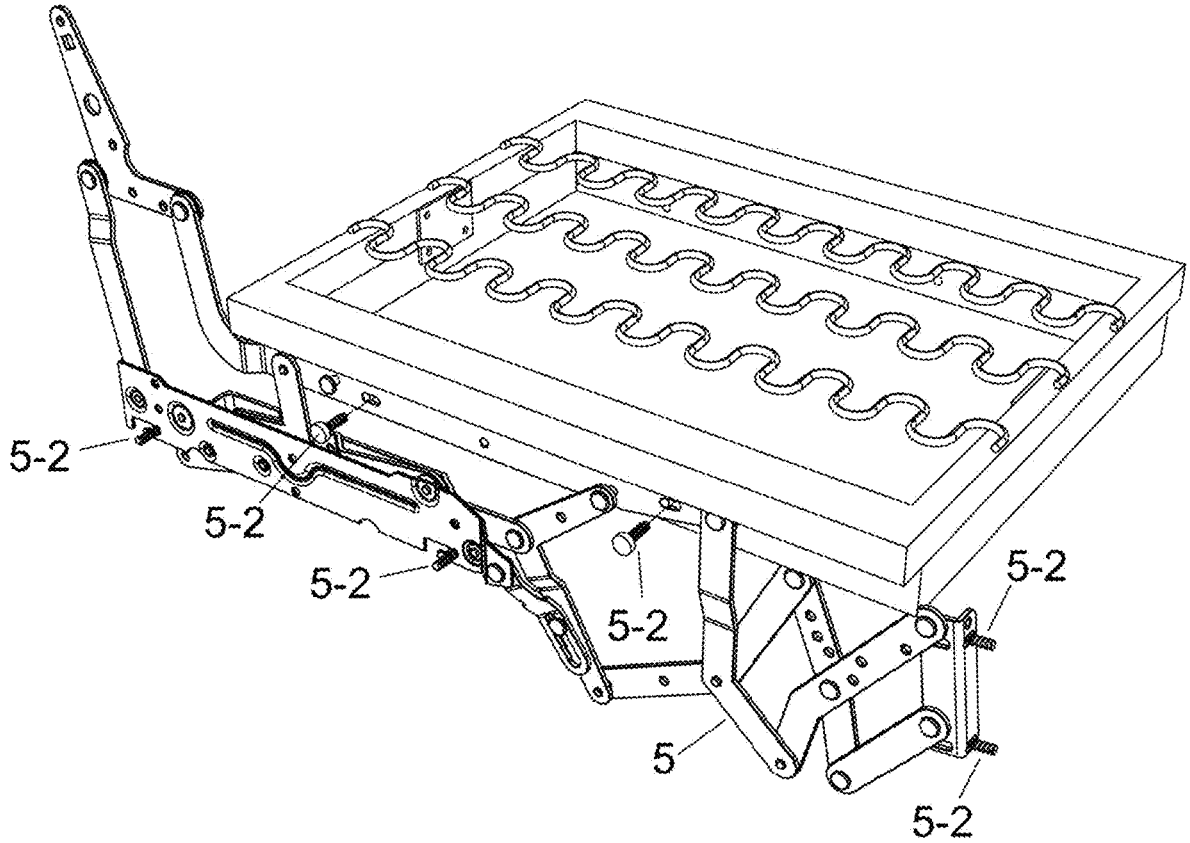
FIG. 7 is a connection diagram of a seat cushion frame and the folding mechanism of the packaging-optimized detachable sofa according to the present disclosure.

FIG. 7 shows a fixing mode between the armrest and the folding mechanism. An outer side of the second seat cushion frame 3-5 and the seat cushion mounting crossbar are provided with corresponding threaded holes. The second seat cushion frame 3-5 is detachably connected to the seat cushion mounting crossbar through second screw 5-2. The second screw 5-2 passes through the threaded hole of the seat cushion mounting crossbar and is threaded to the threaded hole of the second seat cushion frame 3-5. The first seat cushion frame 3-4 is detachably connected to one end of the cushion, and the other end of the cushion is detachably connected to the footrest 4.

Figure 4:
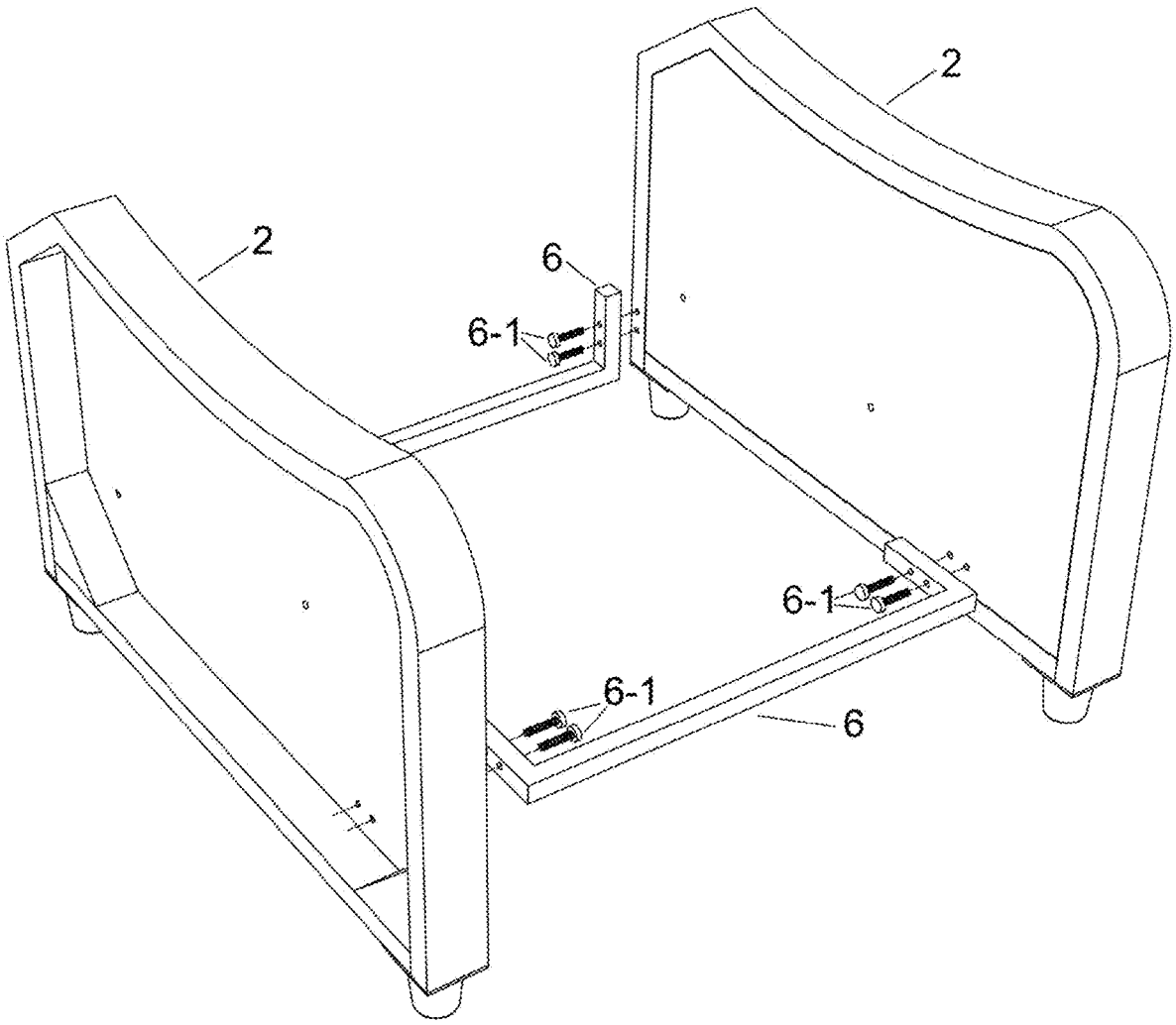
FIG. 4 is a connection diagram of armrest frames at two sides of the packaging-optimized detachable sofa according to the present disclosure.

FIG. 4 shows a fixing method between two armrest frames. The two armrest frames 2 are connected by armrest connecting rods 6. Two ends of the armrest connecting rod 6 are detachably connected to bottoms of the wooden frame structures or wooden board structures of the two armrest frames 2 through third screws 6-1. A bottom corner inside the wooden frame structure is provided with triangular support element 2-2. The bottom of the wooden frame structure is detachably connected to sofa leg 2-4, and gasket 2-3 is provided between the sofa leg 2-4 and the wooden frame structure. Preferably, the armrest connecting rods 6 are U-shaped square tubes, and there are two U-shaped square tubes. The two U-shaped square tubes are located at front and rear ends of the armrest frames 2 to improve the stability of the sofa frame.

Embodiment 2

Figure 10:
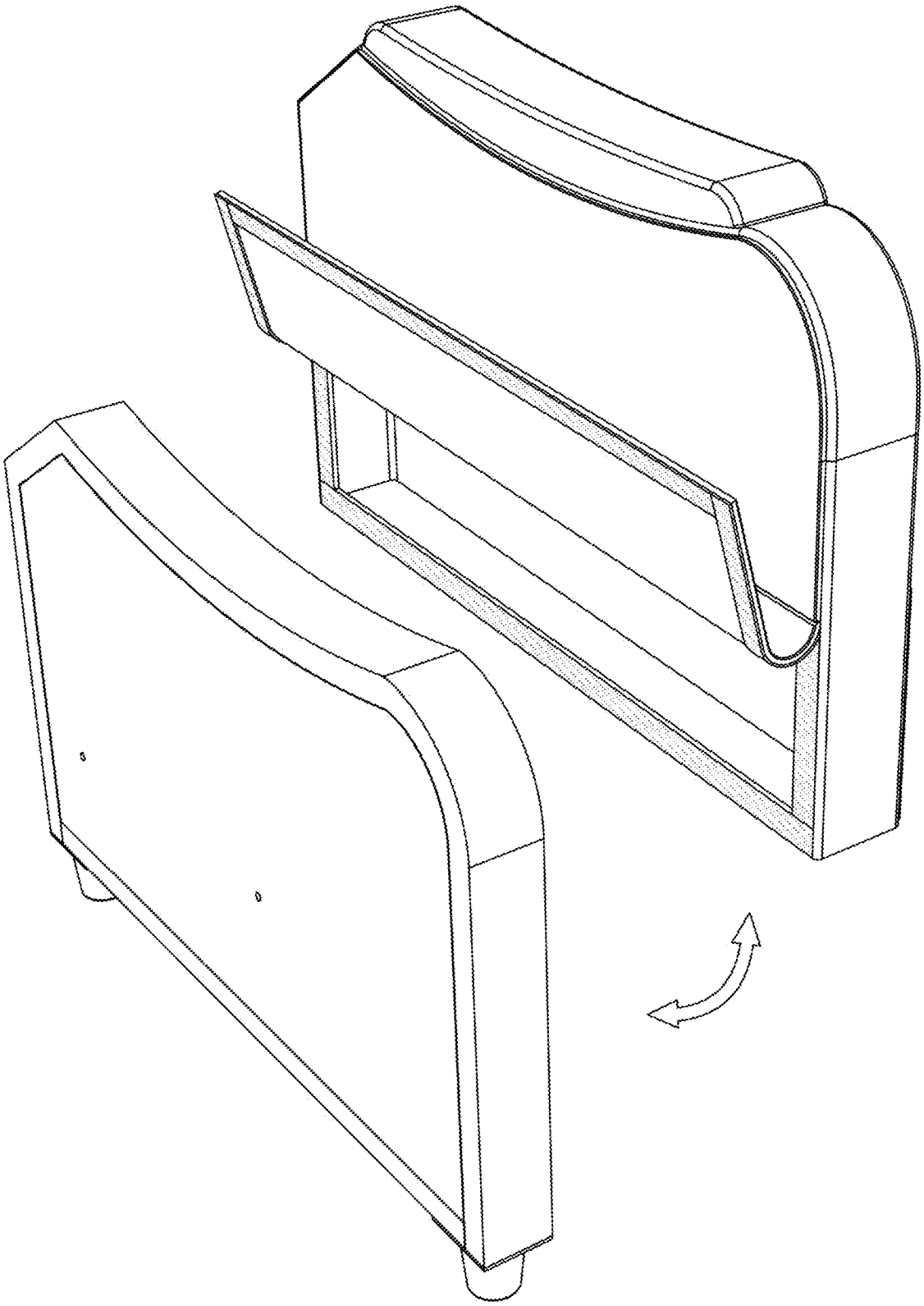
FIG. 10 is a structural diagram of the armrest frame placed in an armrest skin according to the present disclosure.
Figure 11:
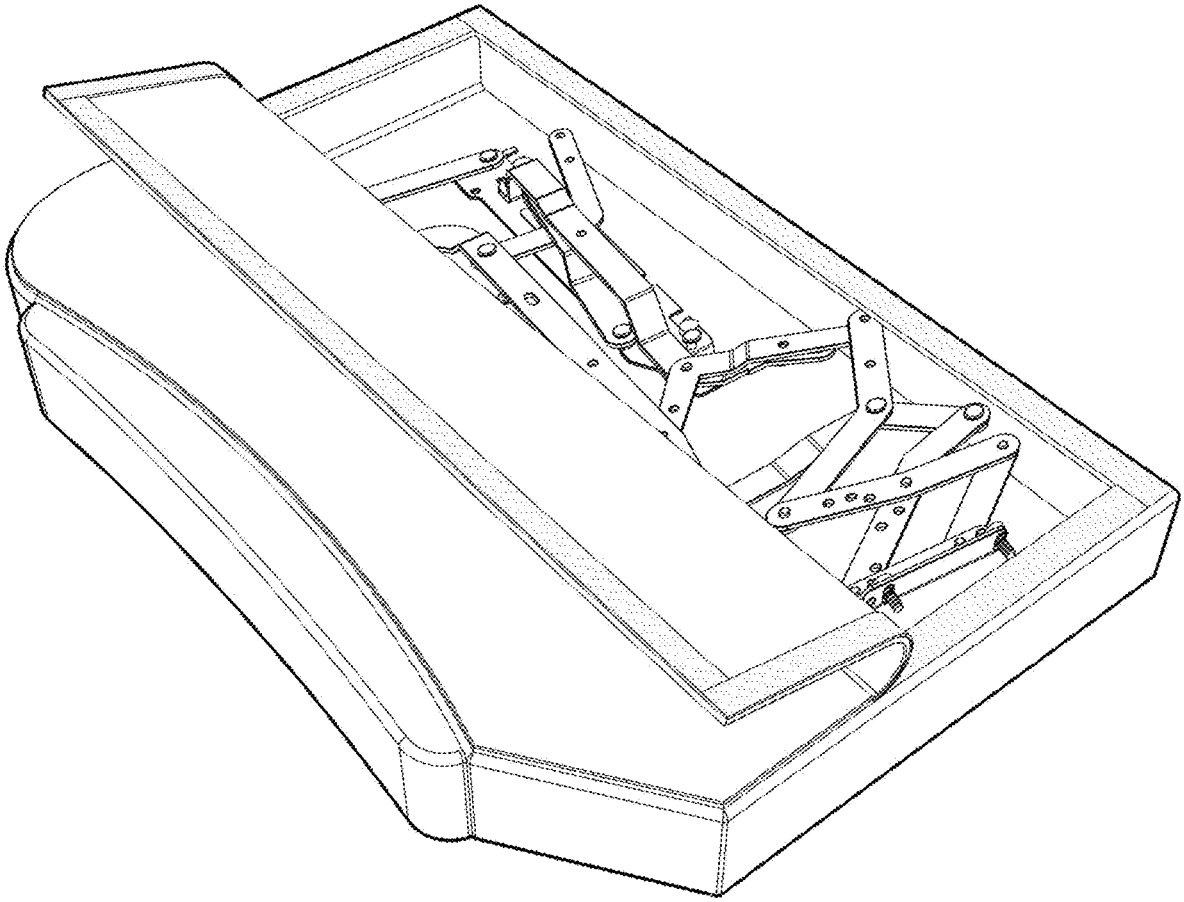
FIG. 11 is a structural diagram of the armrest frame and the folding mechanism placed in the armrest skin according to the present disclosure.

This embodiment mainly relates to an improvement in the storage state of the packaging-optimized detachable sofa. As shown in FIGS. 10 and 11, the armrest connecting rods 6 are matched with the accommodating spaces at the outer sides of the armrest frames 2 in terms of size. When the packaging-optimized detachable sofa is in the storage state, the two armrest connecting rods 6 and the folding mechanism 5 are placed in the accommodating spaces at the outer sides of the two armrest frames 2. The armrest frames 2 are inserted into the armrest skins through the openings at the outer sides of the armrest skins. The openings at the outer sides of the armrest skins are sealed with felt. When the packaging-optimized detachable sofa is disassembled into multiple independent modules, these independent modules can be placed in a storage box. The packaging-optimized detachable sofa achieves proper storage and volume minimization, saves transportation space, and avoids damage of sofa components caused by collision during transportation.

In the description of the present application, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the accompanying drawings, are merely for facilitating the description of the present application and simplifying the description, rather than indicating or implying that an apparatus or element referred to must have a particular orientation or be constructed and operated in a particular orientation, and therefore shall not be interpreted as limiting the present application.

The particular embodiments of the present disclosure are described as above. It should be understood that the present disclosure is not limited to the above specific embodiments. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A packaging-optimized detachable sofa, comprising a backrest support, two armrest frames, two armrest connecting rods, a seat cushion frame, a footrest, and a folding mechanism, wherein the folding mechanism comprises two link assemblies; the two link assemblies are respectively detachably provided at inner sides of the two armrest frames; and the two armrest frames are connected at front and rear ends thereof through the two armrest connecting rods;

the seat cushion frame is detachably provided at middle inner sides of the two link assemblies; the two link assemblies each comprise a first end detachably connected to a bottom end of the backrest support and a second end detachably connected to the footrest; the backrest support is covered by a backrest skin; the two armrest frames are respectively covered by armrest skins; and the seat cushion frame and the footrest each are provided with a cushion; and the packaging-optimized detachable sofa is provided with a storage state; when the packaging-optimized detachable sofa is in the storage state, the backrest support, the two armrest frames, the seat cushion frame, and the footrest are disassembled from the folding mechanism; and the folding mechanism and the two armrest connecting rods are placed in accommodating spaces covered by the armrest skins at sides of the two armrest frames.

2. The packaging-optimized detachable sofa according to claim 1, wherein the backrest support is a U-shaped wooden board structure; and a front side of the backrest support is provided with a plurality of backrest webbings arranged in parallel; and the bottom end of the backrest support is fixedly connected to one end of each of the two link assemblies through a backrest fixing member; the backrest fixing member and the one end of each of the two link assemblies are respectively located at an inner side and an outer side of the bottom end of the backrest support; and the backrest fixing member, the one end of each of the two link assemblies, and the backrest support are detachably connected by screws.

3. The packaging-optimized detachable sofa according to claim 1, wherein an opening is provided at a bottom of the backrest skin; and the backrest support enters the backrest skin through the opening at the bottom of the backrest skin.

4. The packaging-optimized detachable sofa according to claim 1, wherein a middle of each of the two link assemblies is provided with a seat cushion mounting crossbar and an armrest mounting crossbar; and the seat cushion mounting crossbar is located above the armrest mounting crossbar.

5. The packaging-optimized detachable sofa according to claim 4, wherein the two armrest frames each comprise a wooden frame structure and a wooden board structure located at an inner side of the wooden frame structure; the wooden frame structure and the wooden board structure form the accommodating spaces at outer sides of the two armrest frames; and each of the accommodating spaces is matched with the folding mechanism in terms of size; and each of the wooden frame structure and the armrest mounting crossbar is provided with a threaded hole; each of the two armrest frames is detachably connected to the armrest mounting crossbar through a second screw; and the second screw passes through the threaded hole of the wooden frame structure and is threaded to the threaded hole of the armrest mounting crossbar.

6. The packaging-optimized detachable sofa according to claim 4, wherein the seat cushion frame comprises a spring layer, a connecting piece, a first seat cushion frame, and a second seat cushion frame; and the spring layer comprises a plurality of springs arranged in parallel; and the spring layer, the first seat cushion frame, and the second seat cushion frame are fixedly connected in sequence from top to bottom through first screws; and two ends of the connecting piece are respectively fixed at an inner side of the first seat cushion frame and an inner side of the second seat cushion frame through the first screws.

7. The packaging-optimized detachable sofa according to claim 6, wherein each of an outer side of the second seat cushion frame and the seat cushion mounting crossbar is provided with a threaded hole; the second seat cushion frame is detachably connected to the seat cushion mounting crossbar through a second screw; and the second screw passes through the threaded hole of the seat cushion mounting crossbar and is threaded to the threaded hole of the second seat cushion frame; and the first seat cushion frame is detachably connected to a first end of the cushion, and a second end of the cushion is detachably connected to the footrest.

8. The packaging-optimized detachable sofa according to claim 5, wherein two ends of each of the two armrest connecting rods are detachably connected to a bottom of the wooden frame structure or a bottom of the wooden board structure of each of the two armrest frames through third screws; and a bottom corner inside the wooden frame structure is provided with a triangular support element; the bottom of the wooden frame structure is detachably connected to a sofa leg; and a gasket is provided between the sofa leg and the wooden frame structure.

9. The packaging-optimized detachable sofa according to claim 8, wherein the two armrest connecting rods are matched with the accommodating spaces at the outer sides of the two armrest frames in terms of size; and when the packaging-optimized detachable sofa is in the storage state, the two armrest connecting rods and the folding mechanism are placed in the accommodating spaces at the outer sides of the two armrest frames; and the two armrest frames are inserted into the armrest skins through openings at outer sides of the armrest skins; and the openings at the outer sides of the armrest skins are sealed with felt.

10. The packaging-optimized detachable sofa according to claim 1, wherein one end of each of the two link assemblies is detachably connected to the footrest through a second screw.

* * * * *